US010273660B2

(12) United States Patent
You et al.

(10) Patent No.: US 10,273,660 B2
(45) Date of Patent: Apr. 30, 2019

(54) HYDRAULIC SYSTEM OF CONSTRUCTION MACHINERY AND METHOD OF CONTROLLING HYDRAULIC SYSTEM

(71) Applicant: Doosan Infracore Co., Ltd., Incheon (KR)

(72) Inventors: Seung Bum You, Seoul (KR); Woo Yong Jung, Seoul (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 335 days.

(21) Appl. No.: 15/108,312

(22) PCT Filed: Dec. 24, 2014

(86) PCT No.: PCT/KR2014/012774
§ 371 (c)(1),
(2) Date: Jun. 26, 2016

(87) PCT Pub. No.: WO2015/099437
PCT Pub. Date: Jul. 2, 2015

(65) Prior Publication Data

US 2016/0348342 A1 Dec. 1, 2016

(30) Foreign Application Priority Data

Dec. 26, 2013 (KR) ..... 10-2013-0164683

(51) Int. Cl.
*E02F 9/22* (2006.01)
*F15B 11/17* (2006.01)
*F15B 13/06* (2006.01)

(52) U.S. Cl.
CPC ..... *E02F 9/2235* (2013.01); *E02F 9/2203* (2013.01); *E02F 9/2239* (2013.01);
(Continued)

(58) Field of Classification Search
CPC ..... E02F 9/2235; E02F 9/2203; E02F 9/2239; E02F 9/2289; E02F 9/2242; E02F 9/2296; E02F 9/2292; F15B 11/17; F15B 13/06
See application file for complete search history.

(56) References Cited

U.S. PATENT DOCUMENTS

2009/0293468 A1* 12/2009 Kim ..... E02F 9/2066 60/327
2013/0098020 A1* 4/2013 Opdenbosch ..... F15B 7/006 60/327

FOREIGN PATENT DOCUMENTS

JP 2002-242904 A 8/2002
JP 2008-038501 A 2/2008
(Continued)

OTHER PUBLICATIONS

International Search Report for PCT/KR2014/012774 dated Apr. 21, 2015.

*Primary Examiner* — Abiy Teka
(74) *Attorney, Agent, or Firm* — Hauptman Ham, LLP

(57) ABSTRACT

The present disclosure relates to a hydraulic system of construction machinery and a method of controlling the hydraulic system. The hydraulic system of construction machinery and the method of controlling the hydraulic system according to the present disclosure assign a weighted value for each operation, preliminarily distribute a (available torque that can be used) value that an engine can provide, through torque weighted values for each operation, and calculate surplus torque and deficient torque by comparing a preliminary distributable torque value to required torque. The surplus torque is provided for an operation in which torque is deemed to be deficient. Thus, the hydraulic system of construction machinery and the method of controlling the hydraulic system according to the present disclosure can sufficiently use available torque that can be used so that an
(Continued)

operator can achieve a desired level of performance during the operation.

16 Claims, 7 Drawing Sheets

(52) U.S. Cl.
CPC ..... *E02F 9/2242* (2013.01); *E02F 9/2289* (2013.01); *E02F 9/2292* (2013.01); *E02F 9/2296* (2013.01); *F15B 11/17* (2013.01); *F15B 13/06* (2013.01); *F15B 2211/20507* (2013.01); *F15B 2211/20523* (2013.01); *F15B 2211/20546* (2013.01); *F15B 2211/20561* (2013.01); *F15B 2211/20569* (2013.01); *F15B 2211/20576* (2013.01); *F15B 2211/6651* (2013.01); *F15B 2211/76* (2013.01)

(56) References Cited

FOREIGN PATENT DOCUMENTS

| | | | |
|---|---|---|---|
| KR | 10-1998-0018018 | A | 6/1998 |
| KR | 10-0988405 | B1 | 10/2010 |
| KR | 10-2011-0073711 | A | 6/2011 |
| WO | 2013128622 | A1 | 9/2013 |

* cited by examiner (a)

REQUIRED TORQUE RATIO
(WITH RESPECT TO TOTAL OF REQUIRED TORQUES FOR EVERY OPERATION)

(b)

ACTUAL TORQUE DISTRIBUTION RATIO
(WITH RESPECT TO ENGINE TORQUE)

HYDRAULIC SYSTEM OF CONSTRUCTION MACHINERY AND METHOD OF CONTROLLING HYDRAULIC SYSTEM

CROSS REFERENCE TO RELATED APPLICATION

This application claims the priority of Korean Patent Application No. 10-2013-0164683, filed Dec. 26, 2013 in the Korean Intellectual Property Office. Further, this application is the National Phase application of International Application No. PCT/KR2014/012774, filed Dec. 24, 2014, which designates the United States and was published in Korean.

TECHNICAL FIELD

The present disclosure relates to a hydraulic system of construction machinery and a method of controlling a hydraulic system, and more particularly, to a hydraulic system of construction machinery and a method of controlling a hydraulic system which reflects a weighted value for each operation to distribute torque of a plurality of pumps to control the hydraulic system, in a hydraulic system for an excavator of a pump direct control method in which an actuator is directly controlled by a pump.

BACKGROUND ART

Generally, a hydraulic system of construction machinery includes an engine which generates power, a main hydraulic pump which is driven by transmitted power of the engine to eject hydraulic oil, a plurality of actuators which performs an operation, a manipulating unit which is manipulated to operate an actuator of a desired operating machine, and a main control valve which distributes hydraulic oil required by the manipulation of the manipulating unit to a corresponding actuator.

In the manipulating unit, a required command is formed in accordance with a manipulating displacement manipulated by an operator and a flow of the hydraulic oil ejected from the hydraulic pump is controlled by the required command. Examples of the manipulating unit include a joy stick and a pedal.

Further, a rotation torque of the pump needs to vary in order to eject the hydraulic oil from the main hydraulic pump. The torque is referred to as a pump torque. The pump torque T is calculated by a product of a volume of the pump and a pressure P formed in the hydraulic oil. The above-mentioned volume of the pump is a flow of the hydraulic oil which is ejected for one rotation of a shaft of the pump.

According to the above-described hydraulic system which is known in the related art, the hydraulic pump distributes the hydraulic oil ejected from one or two main pumps to each actuator in accordance with control of a main control valve. That is, a pressure of the hydraulic oil ejected from the main control valve necessarily goes through a pressure loss while the hydraulic oil passes through the main control valve and various valves. As a result, energy efficiency may be lowered.

In the meantime, a hydraulic system is illustrated in FIG. 1 of the following Patent Document. More specifically, the hydraulic system disclosed in Patent Document includes a plurality of actuators and a plurality of pumps. Further, each pump is exclusively assigned to each actuator. Furthermore, each control valve is provided on a hydraulic line of each actuator. Each control valve is controlled to determine a flow of the hydraulic oil provided to each actuator and a flowing direction of the hydraulic oil.

However, in the above-described hydraulic system disclosed in the Patent Document, when the control valve is adjusted to operate the corresponding actuator, a pressure loss of the hydraulic oil is generated. The pressure loss adversely affects the fuel efficiency of an excavator.

Further, among the plurality of actuators, a specific actuator may be in an idle state in accordance with the state of an operation of the excavator. However, in spite of the idle state, the pump is continuously driven which causes energy to be consumed.

RELATED ART DOCUMENT

Patent Document

Japanese Patent Application Laid-Open No. P2002-242904A (published on Aug. 28, 2002).

DISCLOSURE

Technical Problem

A technical object of the present disclosure is to provide a hydraulic system of construction machinery and a method of controlling a hydraulic system which reduce a pressure loss and improve fuel efficiency by directly controlling an actuator by a pump, in a hydraulic system of an excavator.

Another object of the present disclosure is to provide a hydraulic system of construction machinery and a method of controlling a hydraulic system which, when there is an actuator in an idle state among a plurality of actuators, distribute a torque which is provided to the actuator in an idle state to other actuators to efficiently use energy, thereby improving fuel efficiency, in a hydraulic system of an excavator.

Technical objects to be achieved in the present disclosure are not limited to the aforementioned technical objects, and other not-mentioned technical objects will be obviously understood by those skilled in the art from the description below.

Technical Solution

An exemplary embodiment of the present disclosure provides a hydraulic system of construction machinery, including: an engine which outputs power to implement torque; a plurality of pumps which is driven by the engine to eject a hydraulic oil; a plurality of actuators which is connected to one or two or more of the plurality of pumps; a control valve which is provided on each hydraulic line to which the plurality of pumps and the plurality of actuators are connected and operated to be open or closed; a power distributing unit which distributes the power which is transmitted from the engine to the plurality of pumps; and a control unit which differently determines a torque distribution ratio in accordance with a weighted value for every operation of each actuator and controls a swash-plate angle of each pump in accordance with the torque distribution ratio.

Herein, when two or more operations are performed, a preliminarily distribution torque ratio may be set in the control unit by distributing a relatively higher torque ratio to an operation which has a high weighted value.

Herein, the control unit may calculate surplus torque and deficient torque for every operation by subtracting preliminary torque for every operation to which a weighted value is applied and required torque for every operation; calculate total of surplus torques by adding surplus torques for every operation; calculate a total of deficient torques by adding deficient torques for every operation; calculate a deficient torque ratio for every operation by dividing the deficient torque for every operation by the total of deficient torques; calculate supplement torque for every operation by multiplying the deficient torque ratio for every operation by the total of surplus torques; and when there is surplus torque, set the surplus torque as required torque for every operation and when there is deficient torque, set a sum of the preliminary torque and the supplementary torque as revised torque to control the swash-plate angle of each pump in accordance with the revised torque.

Herein, an operation of each actuator may be classified such that boom up is a first operation, boom down is a second operation, arm crowd is a third operation, arm dump is a fourth operation, bucket crowd is a fifth operation, and bucket dump is a sixth operation and as a weighted value for every operation, a weighted value may be assigned to torque distribution for every operation so that more torque is distributed to an operation having a high load.

Herein, the operation of each actuator may further include travel as a seventh operation, an auxiliary device operation as an eighth operation, and upper body swing as a ninth operation.

Herein, the plurality of pumps may be hydraulic motors or hydraulic pumps which eject hydraulic oil in both directions.

Herein, the control unit may include a preliminary torque distribution calculating unit, and the preliminary torque distribution calculating unit may calculate a preliminary distribution ratio by dividing a weighted value for every operation by the total of weighted values for every operation and calculate the preliminary torque distribution ratio for every operation by multiplying the preliminary distribution ratio and available torque.

Herein, the control unit may include a required torque calculating unit and an available torque calculating unit, the required torque calculating unit may calculate a required torque value by a pump pressure value provided from each pump and a required flow value generated by manipulating a joy stick or a pedal, and the available torque calculating unit may calculate the available torque value by subtracting the required torque value from the total torque implemented by an actual engine rpm value.

Herein, the control unit may include a required torque calculating unit and an available torque calculating unit, the required torque calculating unit may calculate a required torque value by a pump pressure value provided from each pump and a required flow value generated by manipulating a joy stick or a pedal, and the available torque calculating unit may calculate the available torque value by subtracting the required torque value from the total torque implemented by a target engine rpm value.

Herein, the control unit may include a revised torque distribution calculating unit, and the revised torque distribution calculating unit may calculate surplus torque and deficient torque for every operation by subtracting preliminary torque for every operation and required torque for every operation; calculate a total of surplus torques by adding surplus torques for every operation; calculate a total of deficient torques by adding deficient torques for every operation; calculate a deficient torque ratio for every operation by dividing the deficient torque for every operation by the total of deficient torque; and calculate supplement torque for every operation by multiplying the deficient torque ratio for every operation by the total of surplus torque, and when a specific pump is operated with surplus torque, required torque for every operation may be implemented and when another specific pump is operated with deficient torque, the preliminary distribution torque and the supplementary torque for every operation may be added and revised to perform final torque distribution for every operation.

Another exemplary embodiment of the present disclosure provides a control method of a hydraulic system of construction machinery which is driven by being supplied with power from an engine, includes a plurality of pumps, one or the plurality of pumps being connected to a plurality of actuators, and controls a swash-plate angle of the plurality of pumps to independently adjust torque of the plurality of pumps, including: differently determining a torque distribution ratio in accordance with a weighted value for every operation of each actuator; and controlling a pump torque of each pump to vary in accordance with the torque distribution ratio.

In the control method, an operation of each actuator may be classified such that boom up is a first operation, boom down is a second operation, arm crowd is a third operation, arm dump is a fourth operation, bucket crowd is a fifth operation, and bucket dump is a sixth operation and as a weighted value for every operation, a weighted value may be assigned to torque distribution for every operation so that more torque is distributed to an operation having a high load.

In the control method, the operation of each actuator may further include travel as a seventh operation, an auxiliary device operation as an eighth operation, and upper body swing as a ninth operation.

The control method may further include calculating preliminary torque distribution, and in the calculating of preliminary torque distribution, the preliminary distribution ratio may be calculated by dividing the weighted value for every operation by the total of weighted values and a preliminary torque distribution ratio for every operation may be calculated by multiplying the preliminary distribution ratio and available torque.

The control method may further include calculating required torque; and calculating available torque, and in the calculating of required torque, a required torque value may be calculated by a pump pressure value provided from each pump and a required flow value generated by manipulating a joy stick or a pedal, and in the calculating of available torque, the available torque value may be calculated by subtracting the required torque value from the total torque implemented by an actual engine rpm value.

The control method may further include: calculating required torque; and calculating available torque, and in the calculating of required torque, a required torque value may be calculated by a pump pressure value provided from each pump and a required flow value generated by manipulating a joy stick or a pedal, and in the calculating of available torque, the available torque value may be calculated by subtracting the required torque value from the total torque implemented by a target engine rpm value.

The control method may further include calculating revised torque distribution, and in the calculating of revised torque distribution, surplus torque and deficient torque for every operation may be calculated by subtracting preliminary torque for every operation and required torque for every operation; a total of surplus torque may be calculated by adding surplus torque for every operation; a total of deficient torque may be calculated by adding deficient torque for every operation; a deficient torque ratio for every operation may be calculated by dividing the deficient torque for every operation by the total of deficient torque; supplement torque for every operation may be calculated by multiplying the deficient torque ratio for every operation by the total of surplus torque; and when each pump is operated with surplus torque, required torque for every operation may be implemented and when each pump is operated with deficient torque, the preliminary distribution torque and the supplementary torque for every operation may be added and revised to perform final torque distribution for every operation.

Other detailed matters of the embodiments are included in the detailed description and the drawings.

Advantageous Effects

According to a hydraulic system of construction machinery and a method of controlling a hydraulic system according to the exemplary embodiment of the present disclosure, an actuator is directly controlled by a pump, so that a pressure loss may be reduced, which results in improving fuel efficiency.

According to a hydraulic system of construction machinery and a method of controlling a hydraulic system according to the exemplary embodiment of the present disclosure, required torque, available torque which is output from an engine, and pump torque which is implemented in each pump are considered for every operation, so that a pump which has surplus torque is controlled to reduce the pump torque and a pump which has deficient torque is controlled to increase the pump torque. Therefore, engine torque output from the engine may be aggressively utilized without redundantly wasting engine torque. Therefore, redundantly wasted torque is prevented, so that fuel efficiency may be improved.

DESCRIPTION OF MAIN REFERENCE NUMERALS OF DRAWINGS

Figure 1:
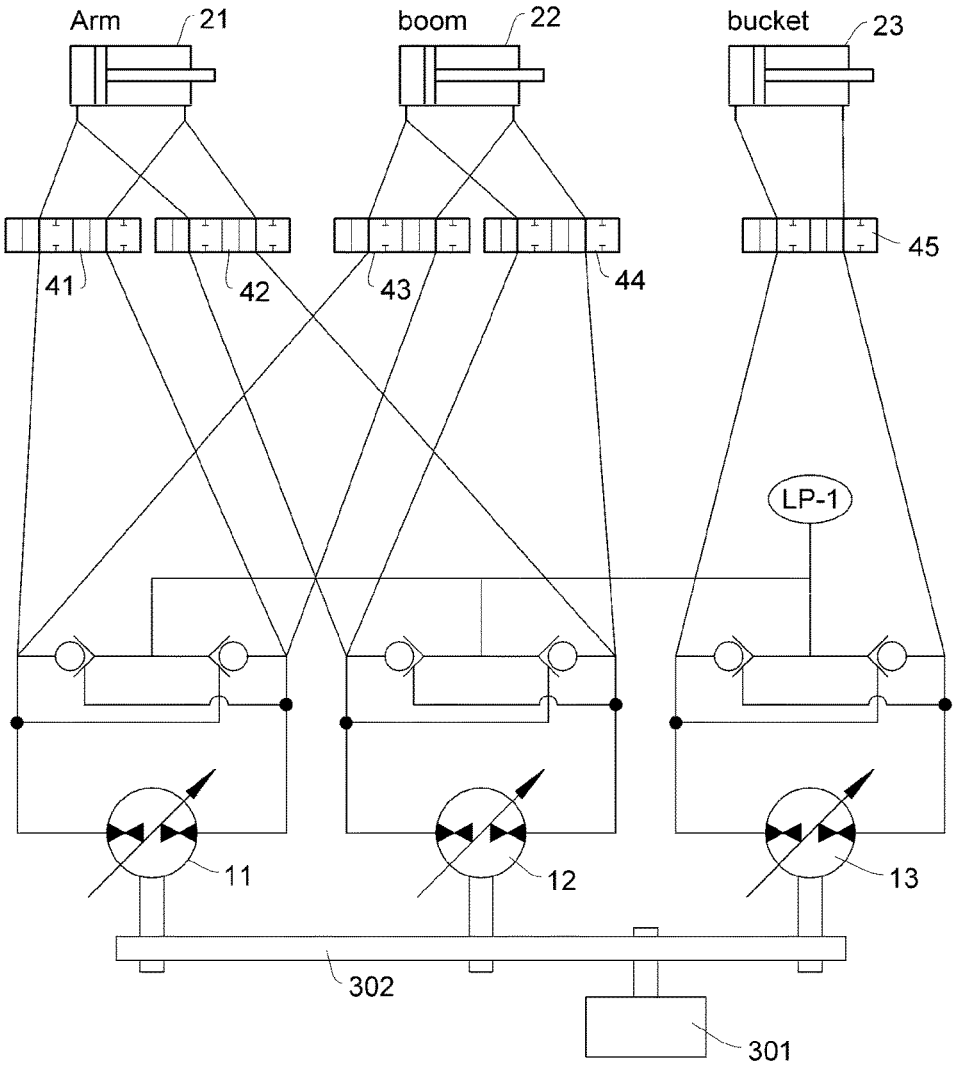
FIG. 1 is a view explaining a hydraulic system of construction machinery according to a comparative embodiment.

11~13: First to third pumps
21~23: First to third actuators
41~45: First to fifth control valves
111~115: First to fifth pumps
121~127: First to seventh actuators
141~152: First to twelfth control valves
200: Control unit
210: Preliminary torque distribution calculating unit
220: Required torque calculating unit
230: Available torque calculating unit
240: Revised torque distribution calculating unit
301, 401: Engine
302, 402: Power distributing unit
LP-1, LP-2: Hydraulic oil charging circuit

BEST MODE

Advantages and characteristics of the present disclosure and a method of achieving the advantages and characteristics will be clear by referring to exemplary embodiments described below in detail together with the accompanying drawings.

Hereinafter, exemplary embodiments of the present disclosure will be described in detail with reference to the accompanying drawings. It should be understood that the exemplary embodiment described below is provided as an example to help the understanding of the present disclosure and the present disclosure may be embodied in various different forms from the exemplary embodiment described herein. Further, in the description of the present disclosure, a detailed explanation and specific drawing of known related functions and components may be omitted when it is determined that the detailed description may unnecessarily make the subject matter of the present disclosure obscure. Further, the accompanying drawings are not illustrated according to an actual size but some components may be excessively illustrated for more understanding of the present disclosure.

Further, the terms used in the description are defined considering the functions of the present disclosure and may vary depending on the intention or usual practice of a manufacturer. Therefore, the definitions should be made based on the entire contents of the present specification.

Like reference numerals indicate like elements throughout the specification.

Comparative Embodiment

It is informed that a comparative embodiment disclosed in the present disclosure is suggested to explain the feature of the present disclosure, but is not a known technology.

Hereinafter, a hydraulic system of construction machinery and a control method of a hydraulic system according to a comparative embodiment will be described with reference to FIGS. 1 and 2.

Figure 2:
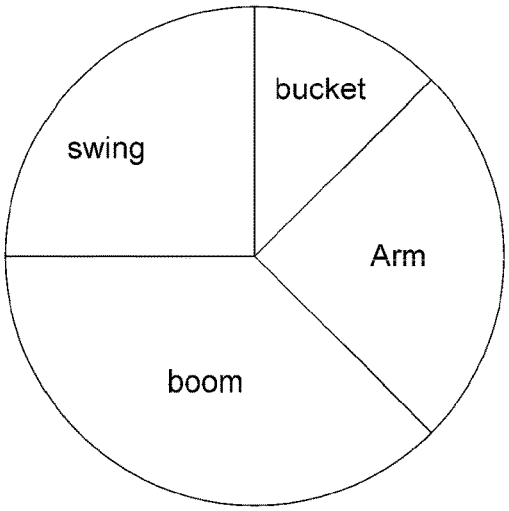
FIG. 2 is a view explaining a torque distribution ratio of a hydraulic system of construction machinery according to a comparative embodiment illustrated in FIG. 1.
Figure 2:
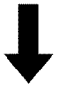
Figure 2:
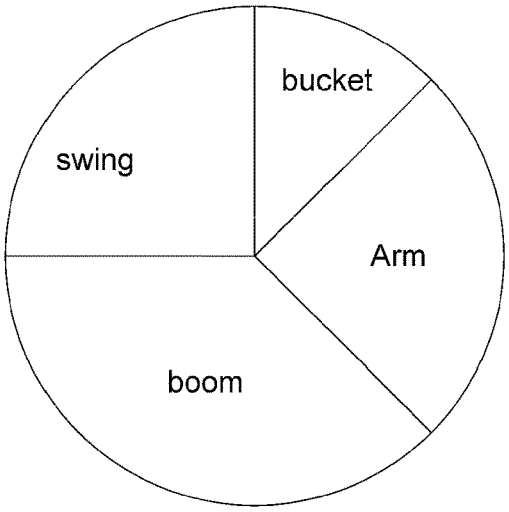

FIG. 1 is a view illustrating a hydraulic system of construction machinery according to a comparative embodiment. FIG. 2 is a view explaining a torque distribution ratio of a hydraulic system of construction machinery according to a comparative embodiment illustrated in FIG. 1.

In a hydraulic system according to a comparative embodiment, a power output from an engine 301 is provided to each of pumps 11 to 13 by a power distributing unit 302. Each of the pumps 11 to 13 ejects a hydraulic oil and actuators 21 to 23 are connected to the pumps, respectively.

More specifically, each of the pumps 11 to 13 ejects the hydraulic oil in both directions and varies a swash-plate angle, and also serves as a motor. Further, each of the pumps 11 to 13 and each of the actuators 21 to 23 form a closed circuit.

Both ends of a first pump 11 and both ports of a first actuator 21 are connected by a hydraulic line and a first control valve 41 which is controlled to be simply open or closed is provided on each hydraulic line. Further, both ends of the first pump 11 and both ports of the first actuator 22 are connected by a hydraulic line and a fourth control valve 44 which is controlled to be simply opened or closed is provided on each hydraulic line.

Similarly, both ends of the second pump 12 and both ports of the first actuator 21 are connected by a hydraulic line and a second control valve 42 which is controlled to be simply opened or closed is provided on each hydraulic line. Further, both ends of the second pump 12 and both ports of the second actuator 22 are connected by a hydraulic line and a third control valve 43 which is controlled to be simply opened or closed is provided on each hydraulic line.

On the other hand, both ends of the third pump 13 and both ports of the third actuator 23 are connected by a hydraulic line and a fifth control valve 45 which is controlled to be simply open or closed is provided on each hydraulic line.

The above-described first actuator 21 may be an arm cylinder which operates an arm, the second actuator 22 may be a boom cylinder which operates a boom, and the third actuator may be a bucket cylinder which operates a bucket.

That is, the first actuator 21 may be supplied with the hydraulic oil from the first pump 11 or the second pump 12. Similarly, the second actuator 22 may be supplied with the hydraulic oil from the first pump 11 or the second pump 12.

On the other hand, a high pressure hydraulic line of each of the pumps 11 to 13 is connected to a hydraulic oil charging circuit LP-1. The hydraulic oil charging circuit includes a charging pump, an accumulator, and a charging relief valve.

The charging pump ejects the hydraulic oil by engine power and supplies the ejected hydraulic oil to the accumulator. The accumulator stores the hydraulic oil and stores pressure energy which is operated by the hydraulic oil. The charging relief valve is open when a pressure of the hydraulic oil to be charged is formed to be higher than a set pressure to maintain the set pressure in the hydraulic oil charging circuit.

However, when a joy stick or a pedal operates while driving an excavator, a required torque which is necessary to operate the actuator is generated. A ratio of a required torque according to the comparative embodiment is as illustrated in portion (a) of FIG. 2. Further, a ratio of the torque which is actually distributed by reflecting a required torque ratio is as illustrated in portion (b) of FIG. 2. That is, the required torque ratio is equal to an actual torque distribution ratio.

For example, in the hydraulic system according to the comparative embodiment, a distribution ratio of the torque is determined for every pump. Therefore, pump torque which may be implemented in each pump is determined in accordance with a ratio of a total available torque. For example, torque of the first pump 11 is determined as 125 Nm, torque of the second pump 12 is determined as 166.7 Nm, and torque of the third pump 13 is determined as 208.3 Nm. In the meantime, the torque of the first pump 11 is distributed to be implemented as 125 Nm. However, actually, higher torque may be required or much lower torque may be implemented.

To be more specific, when the excavator is driven, a specific operation may be required in some cases. For example, when an operation such as boom-up or arm crowd is performed, relatively high torque is required. In contrast, when an operation such as boom down or upper body swing is performed, relatively low torque is required. That is, pump torque which is applied to a corresponding pump may vary in accordance with an operation of the excavator.

However, available torque which is output from the engine is limited and the available torque is distributed to each of the pumps 11 to 13. One arbitrary pump may have surplus torque and the other pump may be overloaded so that an operation of the pump torque may be unstable.

A torque distributing method used in the hydraulic system of the construction machinery according to the comparative embodiment is a distributing method which actually and necessarily assigns more torque to an operation which has high required torque.

Therefore, even though it is necessary for a specific operation in a specific circumstance to use 100% of the required torque, when the engine torque is smaller than a total of the required torque, the control method of a hydraulic system according to the comparative embodiment assigns torque as much as only a ratio of the required torque. Therefore, an actual torque value may be inevitably reduced.

For example, when an arm and a bucket simultaneously operate during a digging operation, all the required torque of an arm needs to be supplied to perform a normal operation. However, the torque is deficiently supplied, so that the arm may not normally operate.

Therefore, as compared with the hydraulic system which is controlled by the main control valve which is known in the related art, a fuel efficiency may be relatively improved, but the torque may not be reasonably distributed.

First Exemplary Embodiment

Figure 3:
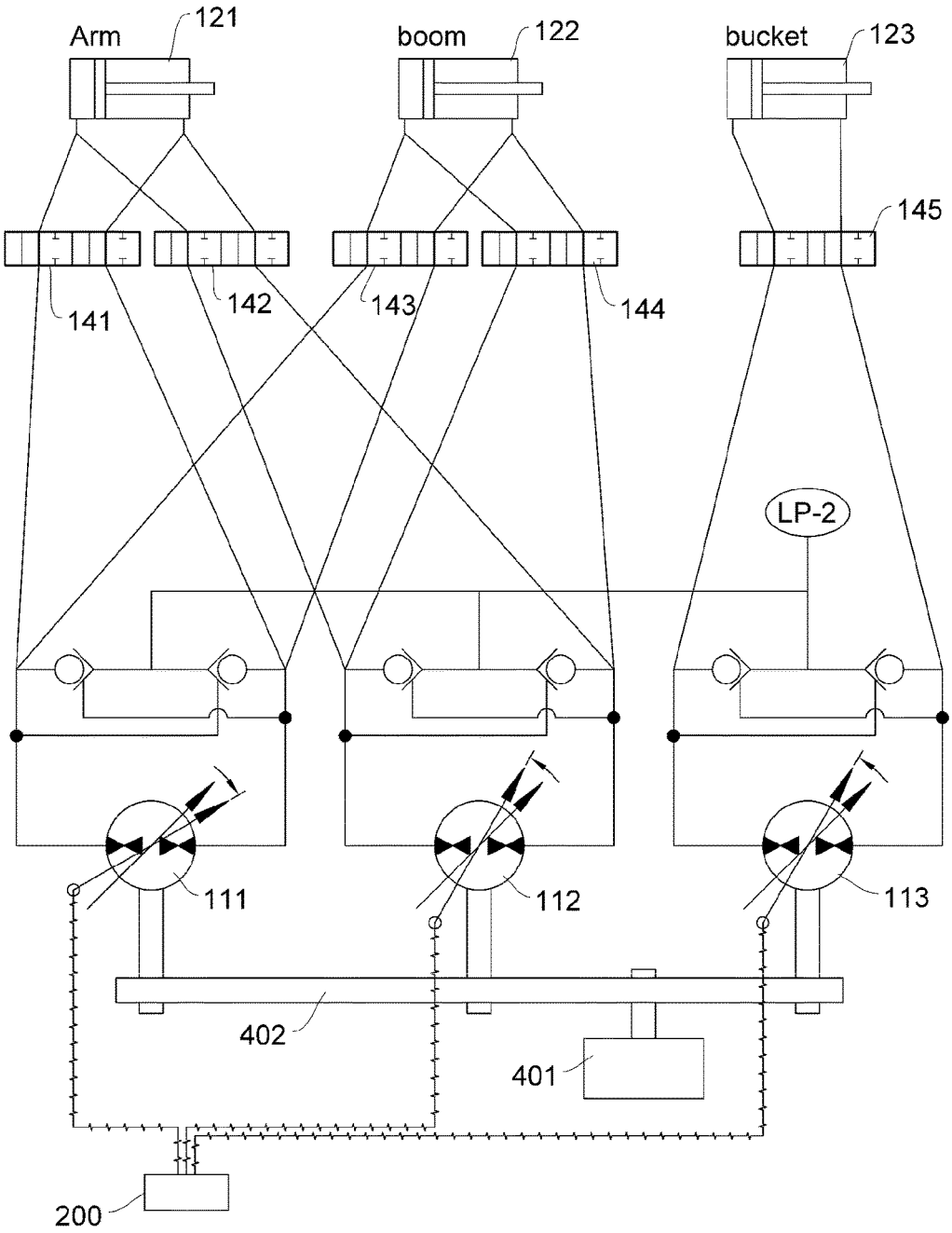
FIG. 3 is a view explaining a hydraulic system of construction machinery according to an exemplary embodiment of the present disclosure.

Hereinafter, a hydraulic system of construction machinery according to an exemplary embodiment of the present disclosure will be described with reference to FIG. 3. FIG. 3 is a view explaining a hydraulic system of construction machinery according to an exemplary embodiment of the present disclosure.

In a hydraulic system according to an exemplary embodiment, a power output from an engine 401 is provided to each of the pumps 111 to 113 by a power distributing unit 402. Each of the pumps 111 to 113 ejects a hydraulic oil and actuators 121 to 123 are connected to the pumps, respectively.

More specifically, each of the pumps 111 to 113 ejects the hydraulic oil in both directions and varies a swash-plate angle, and also serves as a motor. Further, each of the pumps 111 to 113 and each of the actuators 121 to 123 form a closed circuit.

Both ends of the first pump 111 and both ports of a first actuator 121 are connected by a hydraulic line and a first control valve 141 which is controlled to be simply open or closed is provided on each hydraulic line. Further, both ends of the first pump 111 and both ports of the first actuator 122 are connected by a hydraulic line and a fourth control valve 144 which is controlled to be simply open or closed is provided on each hydraulic line.

Similarly, both ends of the second pump 112 and both ports of the first actuator 121 are connected by a hydraulic line and a second control valve 142 which is controlled to be simply opened or closed is provided on each hydraulic line. Further, both ends of the second pump 112 and both ports of the second actuator 122 are connected by a hydraulic line and a third control valve 143 which is controlled to be simply opened or closed is provided on each hydraulic line.

On the other hand, both ends of the third pump 113 and both ports of the third actuator 123 are connected by a hydraulic line and a fifth control valve 145 which is controlled to be simply opened or closed is provided on each hydraulic line.

The above-described first actuator 121 may be an arm cylinder which operates an arm, the second actuator 122 may be a boom cylinder which operates a boom, and the third actuator 123 may be a bucket cylinder which operates a bucket.

That is, the first actuator 121 may be supplied with the hydraulic oil from the first pump 111 or the second pump 112. Similarly, the second actuator 122 may be supplied with the hydraulic oil from the first pump 111 or the second pump 112.

Second Exemplary Embodiment

Figure 7:
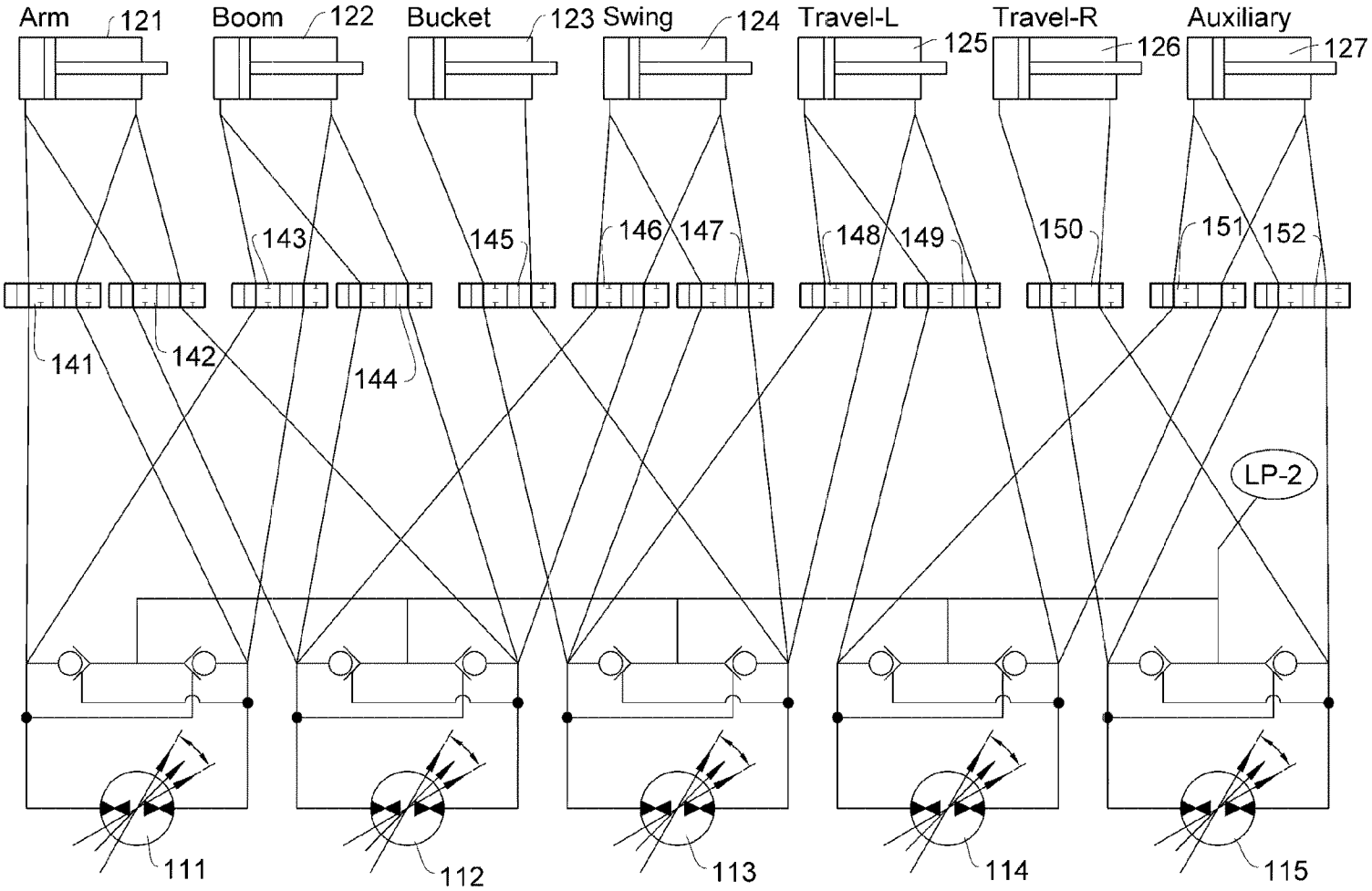
FIG. 7 is a view explaining a hydraulic system of construction machinery and a control method of a hydraulic system according to another exemplary embodiment of the present disclosure.

Further, as illustrated in FIG. 7, a hydraulic system according to another exemplary embodiment of the present disclosure may further include fourth and fifth pumps 114 and 115 and fourth to seventh actuators 124, 125, 126, and 127.

Both ends of the second pump 112 and both ports of a fourth actuator 124 are connected by a hydraulic line and a sixth control valve 146 which is controlled to be simply open or closed is provided on each hydraulic line.

Further, both ends of the third pump 113 and both ports of the fourth actuator 124 are connected by a hydraulic line and a seventh control valve 147 which is controlled to be simply open or closed is provided on each hydraulic line.

Further, both ends of the third pump 113 and both ports of a fifth actuator 125 are connected by a hydraulic line and an eighth control valve 148 which is controlled to be simply opened or closed is provided on each hydraulic line.

Further, both ends of a fourth pump 114 and both ports of the fifth actuator 125 are connected by a hydraulic line and a ninth control valve 149 which is controlled to be simply open or closed is provided on each hydraulic line.

Further, both ends of the fourth pump 114 and both ports of the seventh actuator 127 are connected by a hydraulic line and an eleventh control valve 151 which is controlled to be simply open or closed is provided on each hydraulic line.

Further, both ends of a fifth pump 115 and both ports of a sixth actuator 126 are connected by a hydraulic line and a tenth control valve 150 which is controlled to be simply open or closed is provided on each hydraulic line.

Further, both ends of the fifth pump 115 and both ports of the seventh actuator 127 are connected by a hydraulic line and a twelfth control valve 152 which is controlled to be simply opened or closed is provided on each hydraulic line.

The above-described fourth actuator 124 may be a swing motor which operates an upper body swing and the fifth actuator 125 may be a left-driving motor which operates for left-side driving. The sixth actuator 126 may be a right driving motor which operates for right-side driving and the seventh actuator 127 may be an additional device which drives an additional option device.

That is, the fourth actuator 124 may be supplied with the hydraulic oil from the second pump 112 or the third pump 113. Similarly, the fifth actuator 125 may be supplied with the hydraulic oil from the third pump 113 or the fourth pump 114. The sixth actuator 126 may be supplied with the hydraulic oil from the fifth pump 115. The seventh actuator 127 may be supplied with the hydraulic oil from the fourth pump 114 or the fifth pump 115.

Each pump 111 to 115 includes a hydraulic oil pressure sensor and a swash-plate angle sensor.

The hydraulic oil pressure sensor periodically detects a pressure of the hydraulic oil ejected from each of the pumps 111 to 115 to supply the detected pressure to the control unit 200. Therefore, the control unit 200 calculates a difference between pressures at inlet and outlet of each pump/motor at every detecting time, to monitor and manage the change of the pressure of the hydraulic oil ejected from each of the pumps 111 to 115.

The swash-plate angle sensor periodically detects a swash-plate angle of each of the pumps 111 to 115 to supply the detected swash-plate angle to the control unit 200. The swash-plate angle is used as information for calculating a volume of each of the pumps 111 to 115. That is, the control unit 200 calculates the volume of each of the pumps 111 to 115 at every detecting time to monitor and manage an ejecting flow of the hydraulic oil ejected from each of the pumps 111 to 115.

On the other hand, a high pressure hydraulic line of each of the pumps 111 to 115 is connected to a hydraulic oil charging circuit LP-2. The hydraulic oil charging circuit has been described in the comparative embodiment, so that the redundant description will be omitted.

In the meantime, the control unit 200 is supplied with an engine rpm value from an engine control unit (ECU). The engine rpm is information used to calculate a torque formed in the hydraulic oil.

In the meantime, the swash-plate angle of each of the pumps 111 to 115 is controlled by a control command of the control unit 200. The control command varies the swish-plane angle to change the pump torque.

In order to eject the hydraulic oil from each pump, rotation torque of the pump needs to be varied. The torque is referred to as pump torque. The pump torque T is calculated by a product of a volume of the pump and a pressure P formed in the hydraulic oil. The above-mentioned volume of the pump is a flow of the hydraulic oil which is ejected for one rotation of a shaft of the pump.

The volume of the hydraulic pump may vary by a tilt angle of the swash plate and an engine rpm. The smaller the tilt angle of the swash plate, the smaller the volume. Further, the larger the tilt angle of the swash plate, the larger the volume. The tilt angle of the swash plate is controlled by the control unit. Further, the higher the engine rpm, the more the flow and the lower the engine rpm, the less the flow.

Figure 4:
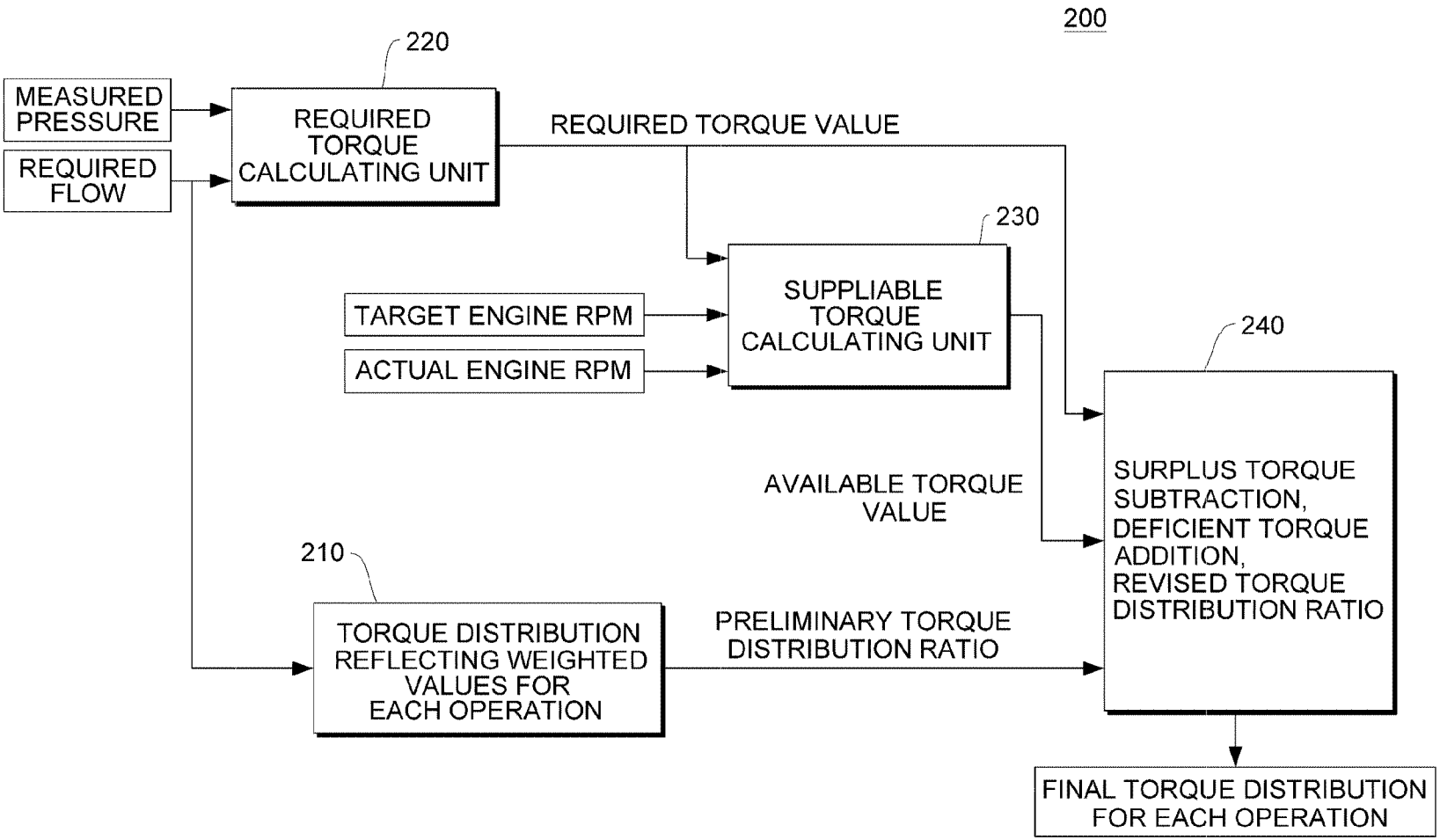
FIG. 4 is a view explaining a control method of a hydraulic system of construction machinery according to an exemplary embodiment of the present disclosure.
Figure 5:
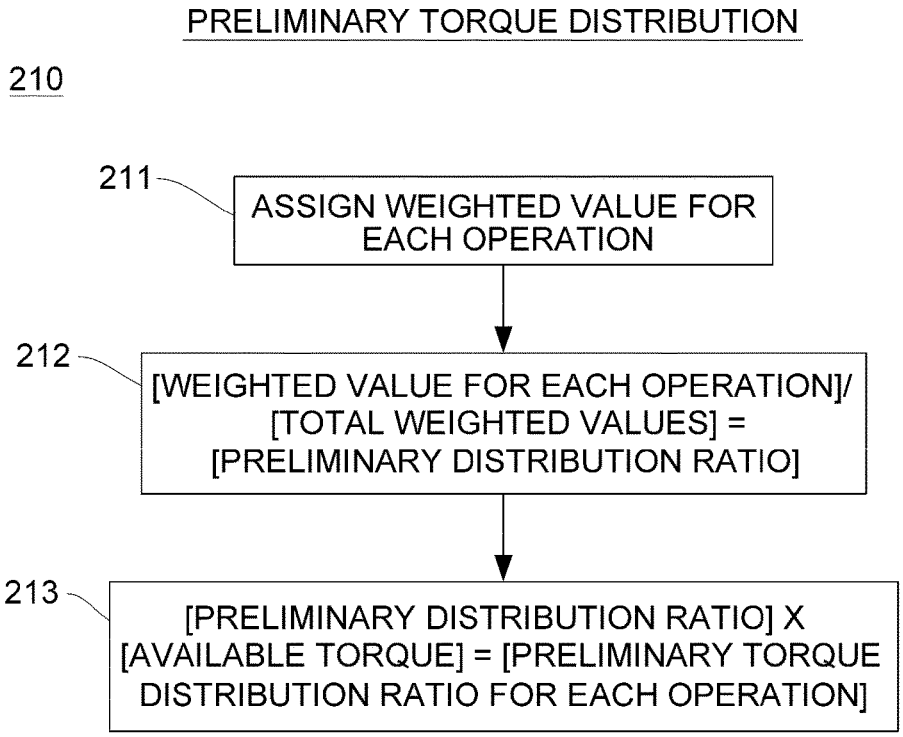
FIG. 5 is a view explaining preliminary torque distribution in a control method of a hydraulic system of construction machinery according to an exemplary embodiment of the present disclosure.
Figure 6:
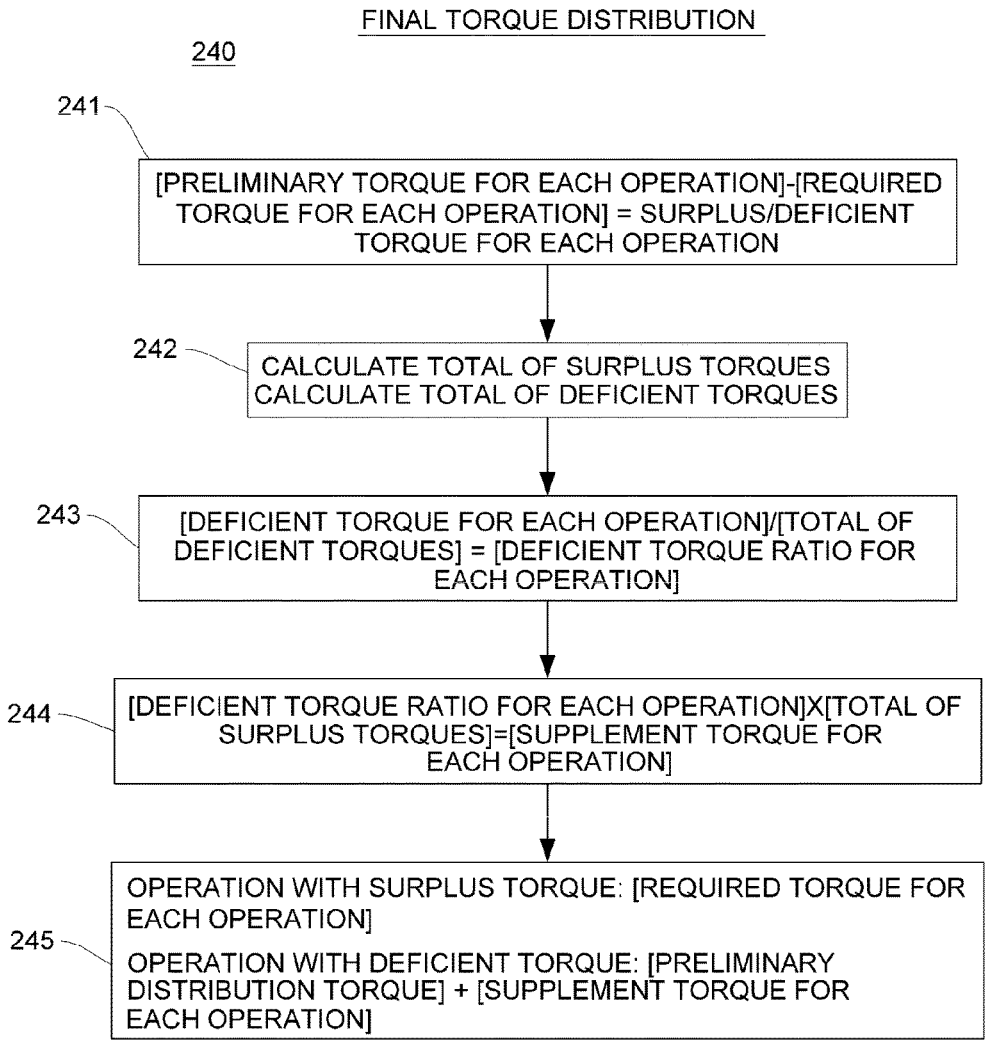
FIG. 6 is a view explaining final torque distribution in a control method of a hydraulic system of construction machinery according to an exemplary embodiment of the present disclosure.

Hereinafter, a control method of a hydraulic system of construction machinery according to an exemplary embodiment of the present disclosure will be described with reference to FIGS. 4 to 6. FIG. 4 is a view explaining a control method of a hydraulic system of construction machinery according to an exemplary embodiment of the present disclosure. FIG. 5 is a view explaining preliminary torque distribution in a control method of a hydraulic system of construction machinery according to an exemplary embodiment of the present disclosure. FIG. 6 is a view explaining final torque distribution in a control method of a hydraulic system of construction machinery according to an exemplary embodiment of the present disclosure.

The control unit 200 calculates a required torque value and an available torque value, and calculates a preliminary torque distribution ratio to which a weighted value for every operation of each of the actuators 121 to 127 is reflected. Further, the control unit 200 calculates a revised torque distribution ratio by subtracting surplus torque and adding deficient torque for every one of the pumps 111 to 115. The swash-plate angle of each of the pumps 111 to 115 is controlled in accordance with the revised torque ratio.

In the meantime, as illustrated in FIG. 3, in accordance with the operation of each of the actuators 121 to 123, operations are classified such that a first operation is a boom up operation, a second operation is a boom down operation, a third operation is an arm crowd operation, a fourth operation is an arm dump operation, a fifth operation is a bucket crowd operation, and a sixth operation is a bucket dump operation.

Further, as illustrated in FIG. 7, a hydraulic system according to another exemplary embodiment of the present disclosure may further include fourth and fifth pumps 114 and 115 and fourth to seventh actuators 124, 125, 126, and 127.

Therefore, the classified operations may further include operations of each actuator which are classified such that a seventh operation is a travel operation, an eighth operation is an auxiliary operation, and a ninth operation is an upper body swing operation.

A weighted value is assigned to the torque distribution for every operation so that more torque is distributed to an operation which has a larger load, which will be described with reference to the following Table 1.

TABLE 1

Example of weighted value for every operation

| Classification of operation | Explanation of operation | Weighted value | Basic setting value of weighted value |
|---|---|---|---|
| First operation | Boom up | 1.5 | 5% |
| Second operation | Boom down | 1 | 5% |
| Third operation | Arm crowd | 1.3 | 10% |
| Fourth operation | Arm dump | 1.3 | 10% |
| Fifth operation | Bucket crowd | 1 | 10% |
| Sixth operation | Bucket dump | 1 | 10% |
| Seventh operation | Travel | 1 | 5% |
| Eighth operation | Auxiliary operation | 1.5 | 5% |
| Ninth operation | Upper body swing | 1.3 | 10% |

The weighted value described in Table 1 is an exemplary value suggested to help the understanding of the present disclosure. Similarly, the basic setting value of the weighted value is an exemplary value suggested to help the understanding of the present disclosure. The above-described weighted value and basic setting value of the weighted value may be set as a default value by a manufacturing company or may be updated in accordance with preference of the operator.

The preference of the operator may be determined in accordance with the type of operation. For example, digging may be a main operation, or a grading operation may be a main operation. Further, an operation which uses an option device such as a crusher or a cutter may be a main operation. Some actuators may require more torque for every operation. In this case, a weighted value and a basic setting value of the weighted value may be newly assigned to the specific operation of the actuator.

Hereinafter, distribution of the torque will be described by referring to the exemplary values suggested in Table 1.

A control method of a hydraulic system of construction machinery according to an exemplary embodiment of the present disclosure preliminarily distributes a (available torque that can be used) value which is provided from the engine through torque weighted values for every operation and calculates surplus torque and deficient torque by comparing a preliminary distributable torque value to required torque.

That is, the control method of a hydraulic system of construction machinery according to the exemplary embodiment of the present disclosure supplies the surplus torque for an operation in which the torque is deemed to be deficient so that operation performance desired by the operator may be achieved while sufficiently utilizing the available torque which can be used.

Data required in the control method of a hydraulic system of construction machinery according to the exemplary embodiment of the present disclosure is a pump pressure in accordance with each operation, a required flow in accordance with each operation, an actual engine rpm which is actually implemented in the engine, and a target engine rpm which is modified corresponding to the required torque.

The control unit 200 includes a preliminary torque distribution calculating unit 210, a required torque calculating unit 220, an available torque calculating unit 230, and a revised torque distributing calculating unit 240.

The preliminary torque distribution calculating unit 210 will be described with reference to FIGS. 4 and 5. The preliminary torque distribution calculating unit 210 assigns a weighted value for each operation (211), calculates the total of weighted values and calculates the preliminary distribution ratio by dividing the weighted value for each operation by the total of the weighted values (212), and calculates the preliminary torque distribution ratio for every operation by multiplying the preliminary distribution ratio and the available torque (213).

As the above-described weighted value, a value represented in Table 1 may be used or an updated weighted value may be used. By doing this, when a specific operation is implemented, more torque is distributed to the corresponding actuator, so that an operation of an operating machine may be smoothly implemented.

The required torque calculating unit 220 and the available torque calculating unit 230 will be described with reference to FIG. 4. The required torque calculating unit 220 calculates a required torque value by a pump pressure value which is supplied from each of the pumps 111 to 115 and a required flow value which is generated by the manipulation of the joy stick or the pedal. More specifically, the required torque may be obtained by multiplying the pump pressure and the required flow. That is, how much the torque is required and how much torque is necessary for each operation may be calculated.

The available torque calculating unit 230 calculates the available torque value by subtracting the above-described required torque value from the total torque which is implemented by the actual engine rpm value. By doing this, a height of the torque at the present time which can be utilized as a torque at the present time may be calculated.

In the meantime, the available torque value may be calculated by subtracting the above-described required torque value from the total torque which is implemented by a target engine rpm value. Therefore, a size of the torque which is implemented when the engine rpm reaches a target engine rpm is calculated.

Further, torque which is implemented by an engine rpm which is targeted by the operator and torque which is actually implemented in the engine are compared to substantially calculate torque which is suppliable by the engine 401.

The revised torque distribution calculating unit 240 calculates the surplus torque and the deficient torque for every operation by subtracting the preliminary torque for every operation and required torque for every operation (241), calculates the total of surplus torque by adding surplus torques for every operation and calculates the total of deficient torque by adding the deficient torques for every operation (242). The revised torque distribution calculating unit 240 calculates a deficient torque ratio for every operation by dividing the deficient torque for every operation by the total of deficient torque (243) and calculates supplementary torque for every operation by multiplying the deficient torque ratio for every operation and the total of surplus torque (244).

When an operation in which torque is surplus is performed in specific pumps 111 to 115, the required torque for every operation is implemented. When an operation in which torque is deficient is performed in specific pumps 111 to 115, the preliminary distribution torque and the supplementary torque for every operation are added and revised to implement the final torque distribution for every operation.

To be more specific, the torque distribution in consideration of a weighted value for every operation will be described below. When a high weighted value is assigned to an operation which requires a high torque distribution value to perform another operation together with the operation, more torque is distributed to the operation to which the high weighted value is assigned, so that the preliminary distribution torque ratio is set.

Further, a time when the weighted value is applied may be set. The applied time may be set immediately after a required flow is generated. However, even though the joy stick is manipulated, there may be a physical time difference until the actuator actually performs a required operation. Therefore, in order to implement the smooth operation of the actuator, a faster applied time would be better.

Hereinafter, an example of preliminary torque distribution in consideration of a weighted value for every operation in the control method of a hydraulic system according to the exemplary embodiment of the present disclosure will be described with reference to an operating example of an operating machine.

[Case 1]

A complex operation of boom down, arm crowd, and bucket crowd is required and all weight-value starting times thoseof exceed 1.

According to Table 1, the boom down is a second operation (a weighted value is 1), the arm crowd is a third operation (a weighted value is 1.3), and the bucket crowd is a fifth operation (a weighted value is 1). A sum of weighted values is obtained by adding 1, 1.3, and 1 and thus 3.3.

A torque distribution ratio for the second operation is calculated by dividing 1 by 3.3 and is 30% as a percentage.

A torque distribution ratio for the third operation is calculated by dividing 1.3 by 3.3 and is 40% as a percentage.

A torque distribution ratio for the fifth operation is calculated by dividing 1 by 3.3 and is 30% as a percentage.

Therefore, in the above-described case 1, the preliminary torque distribution is set such that the boom actuator is 30%, the arm actuator is 40%, and the bucket actuator is 30%.

[Case 2]

A complex operation of boom down, arm crowd, and bucket crowd is required and the remaining operations excluding the arm crowd exceed the weight-value starting time.

According to Table 1, the boom down is a second operation (a weighted value is 1), the arm crowd is a third operation (a weighted value is 1.3), and the bucket crowd is a fifth operation (a weighted value is 1). In this case, when the weighted value starting time is not satisfied, 1 is applied as a default value. Therefore, 1 is applied as a weighted value of the third operation of the arm crowd. A sum of weighted values is obtained by adding 1, 1, and 1 and thus 3.

A torque distribution ratio for the second operation is calculated by dividing 1 by 3.3 and is 33.3% as a percentage.

A torque distribution ratio for the third operation is calculated by dividing 1 by 3.3 and is 33.3% as a percentage.

A torque distribution ratio for the fifth operation is calculated by dividing 1 by 3.3 and is 33.3% as a percentage.

Therefore, in the above-described case 2, the preliminary torque distribution is set such that the boom actuator is 33.3%, the arm actuator is 33.3%, and the bucket actuator is 33.3%.

Hereinafter, an example of revised torque distribution in consideration of surplus torque and deficient torque in the control method of a hydraulic system according to the exemplary embodiment of the present disclosure will be described with reference to an operating example of an operating machine.

[Case 3]

A complex operation of boom down, arm crowd, and bucket crowd is required and all operations exceed the weighted-value starting time.

In the meantime, it is assumed that available torque which is suppliable from an engine is 500 Nm, required torque of boom down is 200 Nm, required torque of arm crowd is 150 Nm, and required torque of bucket crowd is 250 Nm.

1) Calculation of preliminary torque distribution value

Torque distribution value of second operation (boom down) 30%×500=150

Torque distribution value of third operation (arm crowd): 40%×500=200

Torque distribution value of fifth operation (bucket crowd): 30%×500=150

2) Calculation of surplus torque and deficient torque

Second operation (Boom Down): 150−200=−50

In the second operation, the preliminary torque value fails to reach the required torque, so that the torque is determined as deficient torque.

Third operation (Arm Crowd): 200−150=50

In the third operation, the preliminary torque value is surplus to the required torque so that the torque is determined as surplus torque.

Fifth operation (Bucket Crowd): 150−250=−100

In the fifth operation, the preliminary torque value fails to reach the required torque so that the torque is determined as deficient torque.

3) Calculation of deficient torque ratio for every operation

Second operation (Boom Down): 50/(50+100)=33%

Fifth operation (Bucket Crowd): 100/(50+100)=67%

4) Calculation of supplementary torque for every operation

The surplus torque of the third operation is calculated to supplement the second operation and the fifth operation.

Second operation (Boom Down): 33%×50=16.5

Fifth operation (Bucket Crowd): 67%×50=33.5

5) Final distribution torque for every operation

Final torque distribution value of second operation (boom down): 150+16.5=166.5 Nm Final torque distribution value of third operation (arm crowd): 150 Nm Final torque distribution value of fifth operation (bucket crowd): 150+33.5=183.5 Nm On the other hand, when the torque is distributed simply based on the required torque value, the torque is described as follows.

Final torque distribution value of second operation (boom down): 33%×500=166.7 Nm Final torque distribution value of third operation (arm crowd): 25%×500=125 Nm Final torque distribution value of fifth operation (bucket crowd): 42%×500=208.3 Nm When the torque distribution is finally performed, the control unit 200 adjusts a swash-plate angle of each of the pumps 111 to 113. For example, in order to implement the second operation in Case 3, the first pump 111 is controlled such that the torque is increased from 125 Nm to 150 Nm.

Similarly, in order to implement the third operation in Case 3, the second pump 112 is controlled such that the torque is decreased from 166.7 Nm to 166.5 Nm. Further, in order to implement the fifth operation in Case 3, the third pump 113 is controlled such that the torque is decreased from 208.3 Nm to 183.5 Nm.

Accordingly, according to the control method of a hydraulic system according to an exemplary embodiment of the present disclosure, the torque may be redistributed by reflecting a weighted value for every operation and thus more torque may be distributed to an actuator in which a high weighted value is required.

The exemplary embodiments of the present disclosure have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustration in all aspects and are not limited, and the scope of the present disclosure shall be represented by the claims to be described below, and all of the changes or modified forms deduced from the meaning and the scope of the claims, and an equivalent concept thereof are included in the scope of the present disclosure.

INDUSTRIAL APPLICABILITY

The hydraulic system of construction machinery and the control method of the hydraulic system according to the present disclosure may be used to distribute the available torque by reflecting each pump torque to improve fuel efficiency and smoothly implement an operation of each actuator.

The invention claimed is:

1. A hydraulic system of construction machinery, comprising:

an engine which outputs power to implement torque;

a plurality of pumps which is driven by the engine to eject a hydraulic oil;

a plurality of actuators which is connected to one or two or more of the plurality of pumps;

a control valve which is provided on each hydraulic line to which both ends of each of the plurality of pumps and both ports of each of the plurality of actuators are connected and is operated to be opened or closed;

a power distributing unit disposed between the engine and the plurality of pumps which distributes the power which is transmitted from the engine to the plurality of pumps; and a control unit which calculates a preliminary torque for each operation differentially distributed according to a weight for each operation of each of the actuators, calculates a required torque corresponding to a required flow rate generated by operation of a joystick or a pedal, and controls a swash-plate angle of each of the pumps in accordance with a result of subtracting the preliminary torque for each operation and the required torque, wherein the control unit calculates surplus torque and deficient torque for every operation by subtracting preliminary torque for every operation to which a weighted value is applied and required torque for every operation; calculates a total of surplus torques by adding the surplus torque for every operation;

calculates a total of deficient torque by adding the deficient torque for every operation; calculates a deficient torque ratio for every operation by dividing the deficient torque for every operation by the total of deficient torque;

calculates supplement torque for every operation by multiplying the deficient torque ratio for every operation by the total of surplus torque; and when there is deficient torque, sets a sum of the preliminary torque and the supplementary torque as a revised torque to control the swash-plate angle of each pump in accordance with the revised torque.

2. The hydraulic system of claim 1, wherein when two or more operations are performed, the control unit sets a preliminarily distribution torque ratio by distributing a relatively higher torque ratio to an operation which has a higher weighted value.

3. The hydraulic system of claim 2, wherein the control unit sets the required torque for every operation as a revised torque when there is surplus torque, according to the calculation results of surplus torque and deficient torque for each operation.

4. The hydraulic system of claim 1, wherein an operation of each actuator is classified such that boom up is a first operation, boom down is a second operation, arm crowd is a third operation, arm dump is a fourth operation, bucket crowd is a fifth operation, and bucket dump is a sixth operation, and a weighted value is assigned to torque distribution for every operation so that more torque is distributed to an operation having a higher load.

5. The hydraulic system of claim 4, wherein the operation of each actuator further includes travel as a seventh operation, an auxiliary operation as an eighth operation, and an upper body swing as a ninth operation.

6. The hydraulic system of claim 1, wherein the plurality of pumps are hydraulic motors or hydraulic pumps which eject a hydraulic oil in both directions.

7. The hydraulic system of claim 1, wherein the control unit includes a preliminary torque distribution calculating unit, and the preliminary torque distribution calculating unit calculates a preliminary distribution ratio by dividing a weighted value for every operation by the total of weighted values for every operation and calculates the preliminary torque distribution ratio for every operation by multiplying the preliminary distribution ratio by available torque.

8. The hydraulic system of claim 1, wherein the control unit includes a required torque calculating unit and an available torque calculating unit, the required torque calculating unit calculates a required torque value by a pump pressure value provided from each pump and a required flow value generated by manipulating a joy stick or a pedal, and the available torque calculating unit calculates an available torque value by subtracting the required torque value from a total torque implemented by an actual engine rpm value.

9. The hydraulic system of claim 1, wherein the control unit includes a required torque calculating unit and an available torque calculating unit, the required torque calculating unit calculates a required torque value by a pump pressure value provided from each pump and a required flow value generated by manipulating a joy stick or a pedal, and the available torque calculating unit calculates an available torque value by subtracting the required torque value from a total torque implemented by a target engine rpm value.

10. The hydraulic system of claim 1, wherein the control unit includes a revised torque distribution calculating unit, and the revised torque distribution calculating unit calculates surplus torque and deficient torque for every operation by subtracting preliminary torque for every operation and required torque for every operation; calculates a total of surplus torques by adding surplus torques for every operation; calculates a total of deficient torques by adding deficient torques for every operation; calculates a deficient torque ratio for every operation by dividing the deficient torque for every operation by the total of deficient torques; and calculates supplement torque for every operation by multiplying the deficient torque ratio for every operation by the total of surplus torques, and when a specific pump is operated with surplus torque, required torque for every operation is implemented and when another specific pump is operated with deficient torque, the preliminary torque and the supplementary torque for every operation are added and revised to perform final torque distribution for every operation.

11. A control method of a hydraulic system of construction machinery which is driven by being supplied with power from an engine, includes a plurality of pumps, one or the plurality of pumps being connected to a plurality of actuators, and controls a swash-plate angle of the plurality of pumps to independently adjust torque of the plurality of pumps, the method comprising:

differentially determining a torque distribution ratio in accordance with a weighted value for every operation of each actuator; and controlling pump torque of each pump to vary in accordance with the torque distribution ratio, wherein the controlling pump torque of each pump to vary in accordance with the torque distribution ratio, further comprising calculating revised torque distribution, wherein in the calculating of revised torque distribution, surplus torque and deficient torque for every operation are calculated by subtracting preliminary torque for every operation and required torque for every operation; a total of surplus torques is calculated by adding surplus torque for every operation; a total of deficient torques is calculated by adding deficient torque for every operation; a deficient torque ratio for every operation is calculated by dividing the deficient torque for every operation by the total of deficient torques; supplement torque for every operation is calculated by multiplying the deficient torque ratio for every operation by the total of surplus torques; and when each pump is operated with surplus torque, required torque for every operation is implemented and when each pump is operated with deficient torque, the preliminary torque and the supplementary torque for every operation are added and revised to perform final torque distribution for every operation.

12. The control method of claim 11, wherein an operation of each actuator is classified such that boom up is a first operation, boom down is a second operation, arm crowd is a third operation, arm dump is a fourth operation, bucket crowd is a fifth operation, and bucket dump is a sixth operation and a weighted value is assigned to torque distribution for every operation so that more torque is distributed to an operation having a higher load.

13. The control method of claim 12, wherein the operation of each actuator further includes travel as a seventh operation, an auxiliary device operation as an eighth operation, and an upper body swing as a ninth operation.

14. The control method of claim 11, further comprising:

calculating preliminary torque distribution, wherein in the calculating of preliminary torque distribution, the preliminary distribution ratio is calculated by dividing the weighted value for every operation by the total of weighted values and a preliminary torque distribution ratio for every operation is calculated by multiplying the preliminary distribution ratio by available torque.

15. The control method of claim 11, further comprising:

calculating required torque; and calculating available torque, wherein in the calculating of required torque, a required torque value is calculated by a pump pressure value provided from each pump and a required flow value generated by manipulating a joy stick or a pedal, and in the calculating of available torque, an available torque value is calculated by subtracting the required torque value from a total torque implemented by an actual engine rpm value.

16. The control method of claim 11, further comprising:

calculating required torque; and calculating available torque, wherein in the calculating of required torque, a required torque value is calculated by a pump pressure value provided from each pump and a required flow value generated by manipulating a joy stick or a pedal, and in the calculating of available torque, an available torque value is calculated by subtracting the required torque value from a total torque implemented by a target engine rpm value.

* * * * *